US009822555B2

(12) United States Patent
Min et al.

(10) Patent No.: US 9,822,555 B2
(45) Date of Patent: Nov. 21, 2017

(54) SAFETY LOCKING MECHANISM FOR LOCKSET

(71) Applicant: Hao Min, Nanjing (CN)

(72) Inventors: Hao Min, Nanjing (CN); Zhangping Gong, Nanjing (CN)

(73) Assignee: Najing Easthouse Electrical Co., Ltd., Nanjing (CN)

( * ) Notice: Subject to any disclaimer, the term of this patent is extended or adjusted under 35 U.S.C. 154(b) by 0 days.

(21) Appl. No.: 15/310,657

(22) PCT Filed: Nov. 12, 2014

(86) PCT No.: PCT/CN2014/090933

§ 371 (c)(1),
(2) Date: Nov. 11, 2016

(87) PCT Pub. No.: WO2015/176503

PCT Pub. Date: Nov. 26, 2015

(65) Prior Publication Data

US 2017/0122008 A1 May 4, 2017

(30) Foreign Application Priority Data

May 19, 2014 (CN) ..... 2014 2 0252710 U

(51) Int. Cl.
*E05C 3/02* (2006.01)
*E05B 65/00* (2006.01)
(Continued)

(52) U.S. Cl.
CPC ..... *E05B 65/0082* (2013.01); *E05B 17/208* (2013.01)

(58) Field of Classification Search
CPC ..... E05B 65/0082; E05B 17/208
(Continued)

(56) References Cited

U.S. PATENT DOCUMENTS 490,517 A * 1/1893 Stuerwald et al. ..... E05C 3/124 292/227
876,348 A * 1/1908 Hall ..... E05B 55/00 292/221

(Continued)

FOREIGN PATENT DOCUMENTS

CN 2880998 Y 3/2007
CN 2903267 Y 5/2007

(Continued)

OTHER PUBLICATIONS

International Search Report for PCT/CN2014/090933, filed on Nov. 12, 2014. The International Search Report was dated Feb. 17, 2015.

*Primary Examiner* — Kristina R Fulton
*Assistant Examiner* — Faria F Ahmad
(74) *Attorney, Agent, or Firm* — Ming Jiang

(57) ABSTRACT

The present invention relates to a safety locking mechanism for a lockset having a cover plate, a support plate, and a lock body. The safety locking mechanism includes a locking push rod having a direction-limiting shaft and a cylindrical rod, a locking stopper, and a locking compression spring. The direction-limiting shaft is mounted at one end of the cylindrical rod and the other end of the cylindrical rod passes through the support plate and presses against the cover plate. The locking stopper is rotatably mounted on the cylindrical rod and has a front end and a back end being close against the support plate and the lock body respectively. The lock body is provided with a direction-limiting groove. The direction-limiting shaft is mounted in the direction-limiting groove. The locking compression spring is mounted between the direction-limiting shaft and a bottom end of the direction-limiting groove in a compressed manner.

20 Claims, 4 Drawing Sheets

(51) Int. Cl.

| | |
|---|---|
| ***E05B 17/20*** | (2006.01) |
| *E05C 3/04* | (2006.01) |
| *E05C 3/12* | (2006.01) |
| *E05C 3/14* | (2006.01) |
| *E05C 3/16* | (2006.01) |

(58) Field of Classification Search
USPC ..... 292/202, 203, 204, 219, 220, 227, 228, 292/210, 57, 194
See application file for complete search history.

(56) References Cited

U.S. PATENT DOCUMENTS 1,099,626 A * 6/1914 Stevenson ..... E05C 3/124 292/226
1,120,538 A * 12/1914 Richardson ..... E05B 65/1073 292/221
1,147,322 A * 7/1915 Hampton ..... E05B 85/24 292/220
1,664,820 A * 4/1928 Hughes ..... E05C 5/04 292/177
1,954,500 A * 4/1934 Sparks ..... E05C 3/30 292/127
2,293,402 A * 8/1942 Parsons ..... E05B 65/0042 292/138
2,293,700 A * 8/1942 Curtiss, Jr. ..... E05B 65/0042 292/220
2,529,009 A * 11/1950 Foss ..... E05C 3/042 16/441
3,376,088 A * 4/1968 Bol ..... E05C 19/165 292/353
3,492,037 A * 1/1970 Hutchinson ..... E05C 19/165 292/251.5
3,988,859 A * 11/1976 Peterson ..... E05B 51/02 292/201
4,270,781 A * 6/1981 Nishimura ..... E05C 19/165 292/251.5
4,573,333 A * 3/1986 Choi ..... E05B 47/0002 292/18
4,627,249 A * 12/1986 Dumortier ..... E02D 29/1427 292/204
4,702,506 A * 10/1987 Iimura ..... E05C 19/165 292/251.5
4,765,662 A * 8/1988 Suska ..... E05B 63/248 292/219
4,906,036 A * 3/1990 James ..... E05B 63/0056 292/202
4,917,416 A * 4/1990 Westphal ..... E05B 65/0864 292/175
5,370,429 A * 12/1994 Reuber ..... F16F 9/22 188/289
5,592,838 A * 1/1997 Clark ..... E05B 37/00 292/251.5
6,062,613 A * 5/2000 Jung ..... E05B 81/06 292/201
6,217,108 B1 * 4/2001 Sasaki ..... B60R 21/013 180/274
6,224,118 B1 * 5/2001 Ashford ..... E05B 17/208 292/202
6,302,458 B1 * 10/2001 Wang ..... B60R 19/40 293/119
6,364,402 B1 * 4/2002 Sasaki ..... B60R 21/38 180/69.21
6,428,060 B1 * 8/2002 Metz ..... E05C 3/042 292/227
6,502,869 B1 * 1/2003 Rosenquist ..... E05C 3/00 292/202
6,513,617 B2 * 2/2003 Sasaki ..... B60R 21/38 16/222
6,520,276 B2 * 2/2003 Sasaki ..... B60R 21/38 180/274
6,530,449 B2 * 3/2003 Sasaki ..... B60R 21/38 180/274
6,575,503 B1 * 6/2003 Johansson ..... E05B 5/003 292/170
6,802,556 B2 * 10/2004 Mattsson ..... B60R 21/38 180/274
7,234,755 B1 * 6/2007 Senn ..... E05B 47/026 292/DIG. 32
7,273,240 B2 * 9/2007 Migli ..... E05C 19/022 292/251.5
7,299,630 B2 * 11/2007 Browne ..... F03G 7/065 60/527
7,303,040 B2 * 12/2007 Green ..... B62D 25/12 180/274
7,334,656 B2 * 2/2008 Kramarczyk ..... B60R 21/38 180/274
7,374,008 B1 * 5/2008 Neal ..... B60R 21/38 180/274
7,770,944 B2 * 8/2010 Yuan ..... E05B 47/0012 292/195
7,775,566 B2 * 8/2010 Hanjono ..... B60R 7/06 292/202
7,980,603 B2 * 7/2011 Peabody ..... E05B 47/0002 292/137
8,141,671 B2 * 3/2012 Aoki ..... B60R 21/38 180/274
8,191,941 B2 * 6/2012 Ramsauer ..... E05B 9/08 292/194
8,398,125 B2 * 3/2013 Takahashi ..... B60R 21/34 16/222
8,398,127 B2 * 3/2013 Persiani ..... B60K 15/05 292/137
8,490,735 B2 * 7/2013 Farooq ..... B60R 21/38 180/274
8,657,056 B2 * 2/2014 Laspesa ..... F15B 15/1476 180/274
8,684,423 B2 * 4/2014 Stuberg ..... A45C 13/123 220/260
8,881,461 B2 * 11/2014 Derham ..... E05B 43/00 292/338
9,068,616 B1 * 6/2015 Serbu ..... B60G 15/062
9,206,089 B2 * 12/2015 Inuzuka ..... B60R 21/38
2003/0127865 A1 * 7/2003 Gartner ..... E05B 17/2034 292/195
2004/0251697 A1 * 12/2004 Chiang ..... E05B 63/06 292/337
2006/0213709 A1 * 9/2006 Yamaguchi ..... B60R 21/38 180/69.21
2008/0174124 A1 * 7/2008 Takahashi ..... B60R 21/34 292/45
2008/0276672 A1 * 11/2008 Gartner ..... E05B 47/0002 70/277
2008/0303293 A1 * 12/2008 Veijalainen ..... G01R 19/255 292/227
2009/0267360 A1 * 10/2009 Anderson ..... E05B 63/0056 292/202
2010/0321882 A1 * 12/2010 Tracy ..... G06F 1/1616 361/679.55
2012/0223534 A1 * 9/2012 Min ..... E05B 13/005 292/220
2012/0266542 A1 * 10/2012 Szprengiel ..... E05C 19/028 49/503
2013/0307280 A1 * 11/2013 Camp ..... E05B 1/0038 292/228
2015/0115629 A1 * 4/2015 Gartner ..... E05B 17/2092 292/220

FOREIGN PATENT DOCUMENTS

| | | | |
|---|---|---|---|
| CN | 203879127 | U | 10/2014 |
| DE | 3909584 | A1 | 9/1990 |
| JP | 2002242495 | A | 8/2002 |

* cited by examiner

SAFETY LOCKING MECHANISM FOR LOCKSET

FIELD

The present invention relates to the technical field of lockset safety, and more particularly to a safety locking mechanism for a lockset.

BACKGROUND

When a current strongbox lockset is mounted, a door of a strongbox needs to be provided with a through hole for a connection line or a transmission shaft to pass through. If an input unit outside the door of the strongbox is removed, a thin rod can strike the lockset or a lock case after passing through the through hole on the door of the strongbox, such that a relatively weak portion of the lockset is knocked off. In this way, the lockset is possibly opened technically.

Most existing locksets have such a problem that if a lockset is struck from the outside of a door of the strongbox, both a dial and a cover plate inside the lockset may be knocked off, resulting in a hidden danger of technical unlocking.

SUMMARY

The axial movement of the locking stopper is limited.

In view of the disadvantages of the prior art, the present invention provides a safety locking mechanism, in which a component of a lockset would lock a lock mechanism in the lockset when a lock cover is knocked off.

To achieve the aforementioned objective, the present invention employs the following technical solution: a safety locking mechanism for a lockset is provided, the lockset including a cover plate and a lock body, and the safety locking mechanism including a locking push rod, a locking stopper, and a locking compression spring, where the locking push rod includes a direction-limiting shaft and a cylindrical rod, where the direction-limiting shaft is mounted at one end of the cylindrical rod, the cylindrical rod is provided with a helical inclined surface at a position close to the direction-limiting shaft, the helical inclined surface protruding from the cylindrical rod and axially extending along the cylindrical rod, and the other end of the locking push rod presses against the cover plate.

The locking stopper is provided with a specially-shaped hole, the locking stopper is rotatably mounted on the cylindrical rod, a front end of the helical inclined surface is inserted into the specially-shaped hole, and when axially moving in the specially-shaped hole, the helical inclined surface drives the locking stopper to rotate only in a radial direction.

The lock body is provided with a direction-limiting groove having the same cross-sectional shape as the direction-limiting shaft, the direction-limiting shaft is mounted in the direction-limiting groove and is close against a periphery of the direction-limiting groove, the direction-limiting shaft is slidable in the direction-limiting groove only in an axial direction, and the locking compression spring is mounted between the direction-limiting shaft and a bottom end of the direction-limiting groove in a compressed manner.

Further, the lockset further includes a support plate, and a front end and a back end of the locking stopper are close against the support plate and the lock body respectively.

Further, an inner surface of the specially-shaped hole is a helical surface fit with the helical inclined surface, and when the helical inclined surface passes through the specially-shaped hole, the helical surface is driven by the helical inclined surface.

Further, after the cover plate is separated from the locking push rod, the locking push rod is elevated by the locking compression spring, the locking push rod axially moves forward, and the specially-shaped hole is driven by the helical inclined surface, thereby driving the locking push rod to rotate radially.

Further, when the support plate presses against the cover plate, the locking stopper is located outside a moving passage of a locking shaft of the lockset.

Further, when the cover plate is separated from the support plate, the locking stopper rotates to an intersection with a moving passage of a locking shaft of the lockset.

Further, the direction-limiting shaft is fixed at one end of the locking push rod, and the other end of the locking push rod passes through the specially-shaped hole of the locking stopper and the support plate in order, and closely presses against the cover plate.

Further, the locking shaft is used to control locking and rotation of a lock tongue of the lockset.

Further, the cross-sectional shape of the direction-limiting shaft is a polygon.

Further, the direction-limiting shaft is a circular shaft, the circular shaft is provided with an axial key groove, a limiting key fit with the key groove is fixed on an inner wall of the direction-limiting groove, and the limiting key is slidable in the key groove in the axial direction.

The beneficial effects of the present invention are as follows:

The present invention provides a safety locking mechanism in which a component of a lockset would lock a lock mechanism in the lockset when a lock cover is knocked off, such that the difficulty of technical unlocking is greatly increased and the lockset safety is improved; meanwhile, the present invention is simple in structure and ingenious in design while achieving an unexpected safety effect.

BRIEF DESCRIPTION OF THE DRAWINGS

FIG. 3-1 is a schematic structural view of the safety locking mechanism during normal work of a lockset; and FIG. 3-2 is a schematic structural view after separation of a cover plate of the lockset; and FIG. 4-1 is a schematic view of positions of the locking stopper and a locking shaft during normal work of the lockset; and FIG. 4-2 is a schematic view of positions of the locking stopper and the locking shaft during separation of the cover plate of the lockset.

DETAILED DESCRIPTION

Figure 1:
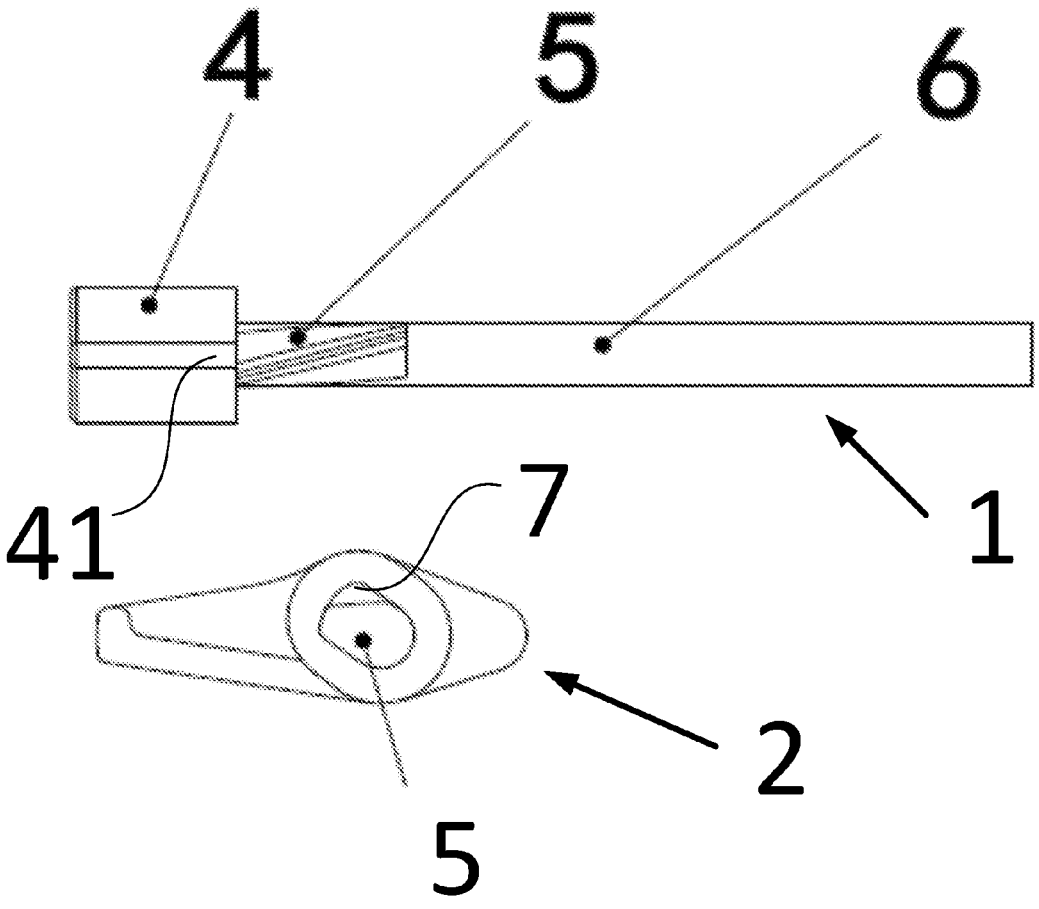
FIG. 1 is a schematic view of a locking push rod and a locking stopper of a safety locking mechanism according to the present invention.

In order to make the objectives and technical solutions of the embodiments of the present invention clearer, the technical solutions of the embodiments of the present invention are clearly and completely described below with reference to the accompanying drawings of the embodiments of the present invention. It is obvious that the described embodiments are merely a part rather than all of the embodiments of the present invention. Based on the embodiments of the present invention, all other embodiments derived by persons of ordinary skill in the art without creative effort shall fall within the protection scope of the present invention.

Persons skilled in the art can understand that, unless otherwise defined, all terms (including technical and scientific terms) used herein have the same meaning as commonly understood by persons of ordinary skill in the art. It should be further understood that, terms, such as those defined in commonly used dictionaries, should be understood as having a meaning consistent with their meaning in the context of the prior art, and will not be interpreted in an idealized or overly formal sense unless expressly so defined herein.

The term "and/or" in the present invention means that either or both elements may be present.

The terms "inner and outer" in the present invention refer to, relative to a device itself, a direction toward the interior of the device and an opposite direction respectively and are not intended to specifically limit the apparatus and mechanism of the present invention.

The terms "left and right" in the present invention refer to, when a reader is facing the drawing, the left side of the reader and the right side of the reader respectively and are not intended to specifically limit the apparatus and mechanism of the present invention.

The term "connection" in the present invention may refer to direct connection between components or indirect connection between the components through other components.

The terms "clockwise" and "anticlockwise" in the present invention refer to a clockwise direction and an anticlockwise direction shown in the accompanying drawings respectively, are defined for helping the reader to read and understand, and are not intended to specifically limit the apparatus and mechanism of the present invention.

Figure 2:
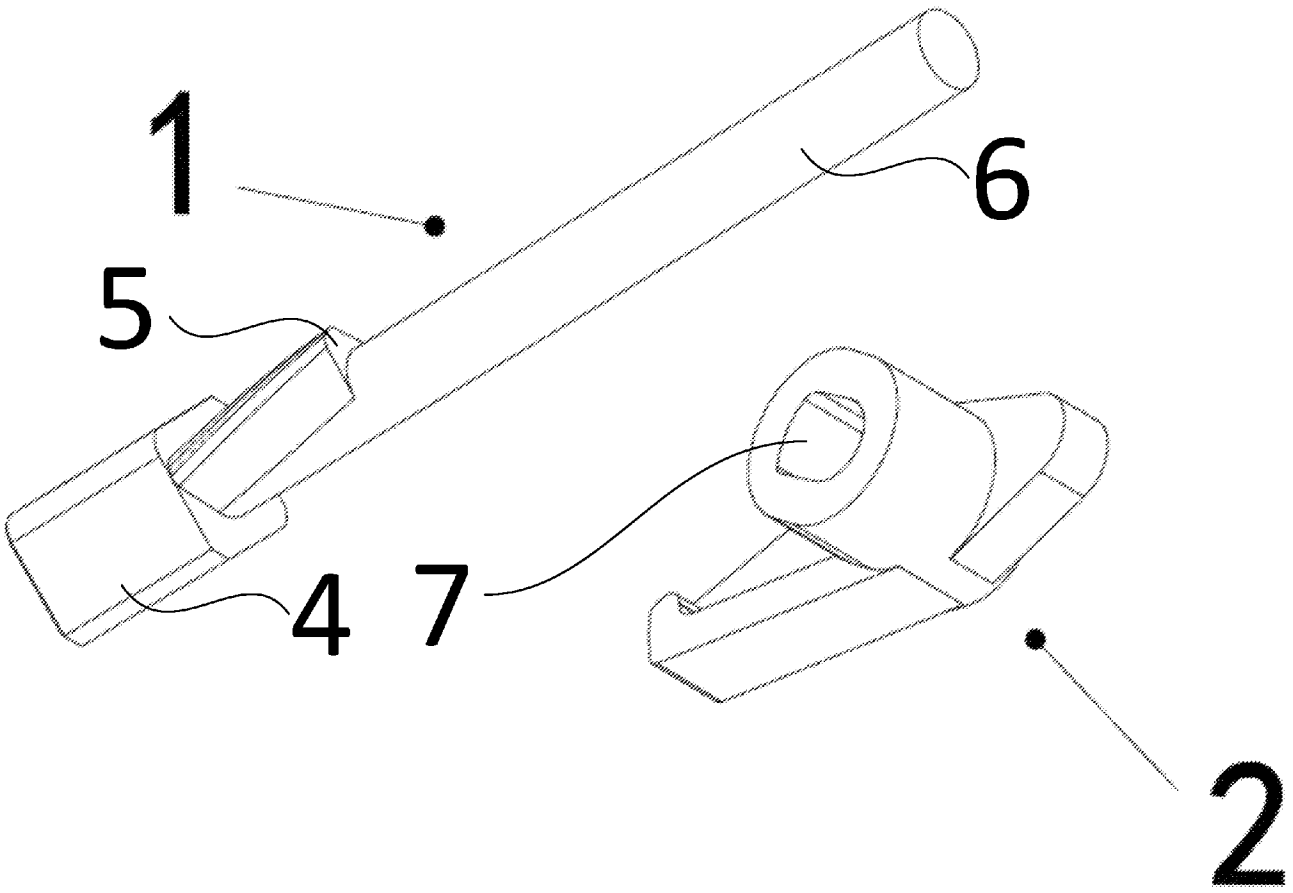
FIG. 2 is an oblique view of the locking push rod and the locking stopper of the safety locking mechanism according to the present invention.
Figures 1, 3:
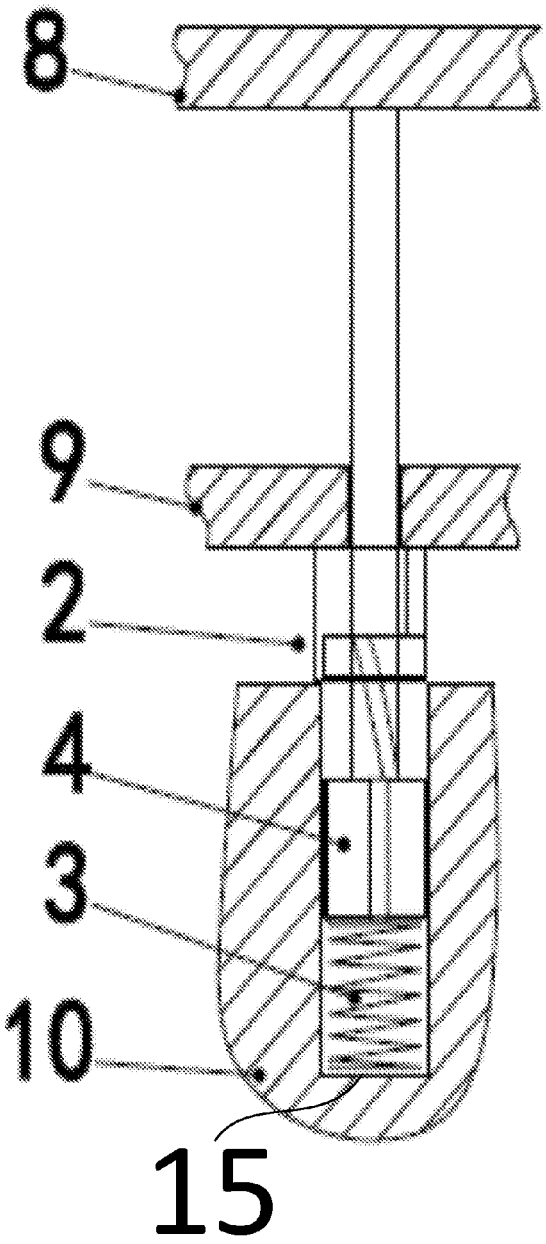
Figures 2, 3:
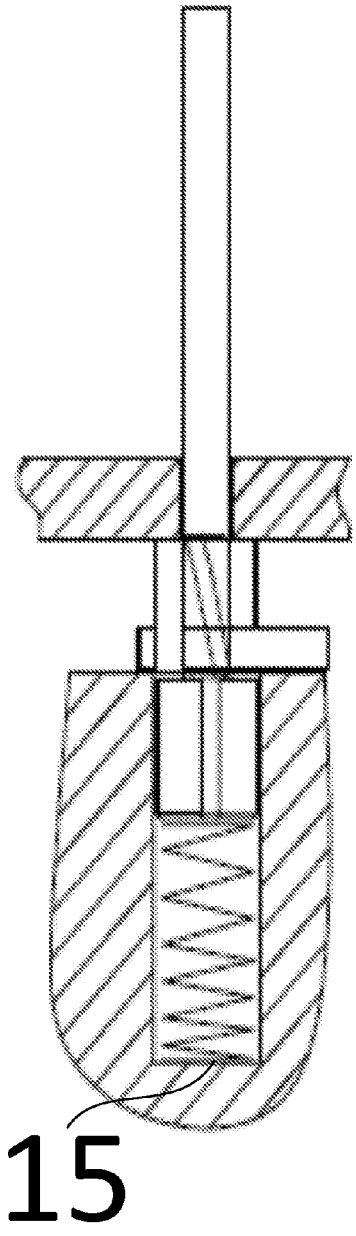
Figures 1, 4:
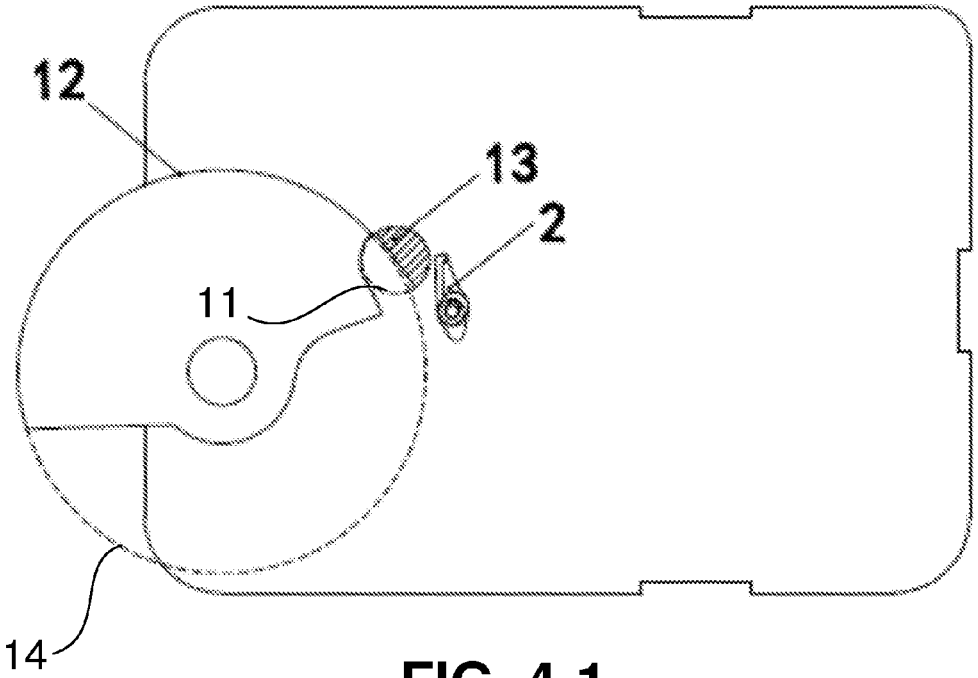
Figures 2, 4:
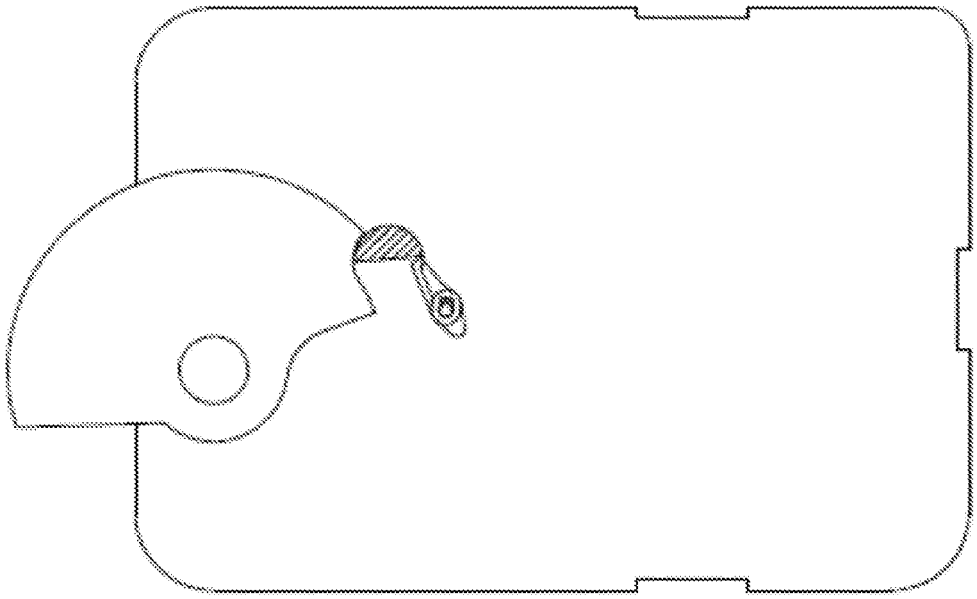

FIG. 1 is a schematic view of a locking push rod and a locking stopper of a safety locking mechanism according to certain embodiments of the present disclosure; FIG. 2 is an oblique view of the locking push rod and the locking stopper of the safety locking mechanism according to certain embodiments of the present disclosure; FIG. 3-1 is a schematic structural view of the safety locking mechanism during normal work of a lockset according to certain embodiments of the present disclosure; FIG. 3-2 is a schematic structural view when a cover plate of the lockset is removed according to certain embodiments of the present disclosure; FIG. 4-1 is a schematic view of positions of the locking stopper 2 and a locking shaft 13 during normal operation of the lockset according to certain embodiments of the present disclosure; and FIG. 4-2 is a schematic view of positions of the locking stopper 2 locking the locking shaft 13 the cover plate 8 of the lockset is removed according to certain embodiments of the present disclosure.

As shown in FIG. 1 to FIG. 3, a safety locking mechanism for a lockset is provided. The lockset includes a cover plate 8, a support plate 9, and a lock body 10, as shown in FIGS. 3-1 and 3-2. The safety locking mechanism includes a locking push rod 1, a locking stopper 2, and a locking compression spring 3, as shown in FIGS. 1 and 2. The locking push rod 1 includes a direction-limiting shaft 4 and a cylindrical rod 6. The direction-limiting shaft 4 is mounted at one end of the cylindrical rod 6. The lock body 10 defines a direction-limiting groove 15, and the direction-limiting shaft 4 is mounted in the direction-limiting groove 15, as shown in FIGS. 3-1 and 3-2. The locking compression spring 3 is mounted between the direction-limiting shaft 4 and a bottom end of the direction-limiting groove 15 in a compressed manner. The shape of the direction-limiting shaft 4 matches and the shape of the direction-limiting groove 15, the direction-limiting shaft 4 is limited to move in an up and down direction under the compression force of the locking compression spring 3, and not rotatable around the axial of the direction-limiting-groove 15. In one embodiment, as shown in FIG. 2, the direction-limiting shaft 4 has a rectangular shape or square shape with rounded corners. In another embodiment, as shown in FIG. 1, the direction-limiting shaft 4 has a round shape with an axial key groove 41. When the direction-limiting groove 15 includes a matching limiting key (not shown in FIGS. 3-1 and 3-2), the direction-limiting groove 15 can also ensure that the direction-limiting shaft 4 only moves in an up and down direction. The cylindrical rod 6 is provided with a helical inclined surface 5 at a position adjacent to the direction-limiting shaft 4, the helical inclined surface 5 axially extending along the surface of the cylindrical rod 6, as shown in FIGS. 1 and 2, and the other end of the locking push rod 1 passes through the support plate 9 and presses against the cover plate 8, as shown in FIG. 3-1. The locking stopper 2 defines a specially-shaped hole 7, as shown in FIGS. 1 and 2. The specially-shaped hole 7 includes a space having the same cross-section similar to the cross-sections of the helical inclined surface 5 such that the helical inclined surface 5 section of the locking push rod 1 fits into the specially-shaped hole 7. The locking stopper 2 is rotatably mounted on the cylindrical rod 6, a front end of the helical inclined surface 5 is inserted into the specially-shaped hole 7, the specially-shaped hole 7 is driven by the helical inclined surface 5. The locking stopper 2 is installed between the support plate 9 and the lock body 10 with a first end facing the support plate 9 and a second end facing the lock body 10, respectively.

In certain embodiments, as shown in FIG. 3-2 of FIG. 3, after the cover plate 8 is removed, the locking push rod 1 moves upwards as shown in FIG. 3-2, under the compression force of the locking compression spring 3, the helical inclined surface 5 section of the locking push rod 1 drives the specially-shaped hole 7 to rotate the locking stopper 2 such that the locking stopper 2 moves into a moving passage 11 of the locking shaft 13 to drive the locking shaft 13 into a moving passage 14 of a lock tongue 12 to lock the lock tongue 12.

As shown in FIG. 4-1, when the locking push rod 1 presses against the cover plate 8, the locking stopper 2 is located outside a moving passage 11 of the locking shaft 13 of the lockset. As shown in FIG. 4-2, when the cover plate 8 is removed, the locking stopper 2 rotates to an intersection with the moving passage 11 of the locking shaft 13 of the lockset.

In certain embodiments, the direction-limiting shaft 4 is fixed at one end of the locking push rod 1. The other end of the locking push rod 1 passes through the specially-shaped hole 7 of the locking stopper 2 and the support plate 9 in order, and presses against the cover plate 8. The locking shaft 13 is used to control locking and rotation of a lock tongue 12 of the lockset. Therefore, the locking stopper 2 drives the locking shaft 13 to a position where the lock tongue 12 is blocked by the locking shaft 13 and the lock tongue 12 is then locked when the cover plate 8 is removed.

In certain embodiments, the cross-sectional shape of the direction-limiting shaft may include a polygon, for example, a triangle or a quadrangle.

In certain embodiments, the direction-limiting shaft 4 may also be a circular shaft, as shown in FIG. 1, and the circular direction-limiting shaft 4 includes the axial key groove 41. The direction-limiting groove 15 may include a matching limiting key (not shown in FIGS. 3-1 and 3-2) on an inner wall of the direction-limiting groove. The limiting key fits in the axial key groove 41. The limiting key is slidable in the key groove in an axial direction to ensure that the locking push rod 1 moves only in up and down direction and not rotatable around the locking push rod 1.

The implementations of the present invention are specifically described in detail, but they are not to be construed as limiting the scope of the present invention. It should be noted that, several modifications and improvements can be made by persons of ordinary skill in the art without departing from the concept of the present invention. All these modifications and improvements are within the protection scope of the present invention.

What is claimed is:

1. A safety locking mechanism for a lockset, having a cover plate and a lock body, comprising:

a locking push rod having a direction-limiting shaft and a cylindrical rod, wherein the direction-limiting shaft is mounted at a first end of the cylindrical rod, the cylindrical rod defines a helical inclined surface at a adjacent to the direction-limiting shaft, the helical inclined surface protruding from the cylindrical rod and axially extending along the surface of the cylindrical rod, and a second end of the cylindrical rod presses against the cover plate of the lockset;

a locking stopper defines a specially-shaped hole, wherein the specially-shaped hole includes a space having a cross-section similar to the cross-section of the helical inclined surface such that the helical inclined surface section of the locking push rod fits into the specially-shaped hole, the locking stopper is rotatably mounted on the cylindrical rod, a front end of the helical inclined surface is inserted into the specially-shaped hole, and when axially moving in the specially-shaped hole, the helical inclined surface drives the locking stopper to rotate only in a radial direction, wherein the lock body comprises a lock tongue for locking and unlocking the lockset, a locking shaft for providing the safety lock mechanism to the lockset by locking the lock tongue when the cover plate is removed, and the lock body defines a direction-limiting groove having the same cross-sectional shape as the direction-limiting shaft, the direction-limiting shaft is fitted in the direction-limiting groove allowing the direction-limiting shaft to be slidable in the direction-limiting groove only in an axial direction, and a locking compression spring is mounted between the direction-limiting shaft and a bottom end of the direction-limiting groove in a compressed manner to elevate the locking push rod, rotate the locking stopper and lock the lock tongue when the cover plate is removed.

2. The safety locking mechanism for a lockset according to claim 1, wherein the lockset further comprises a support plate, and a first end of the locking stopper faces the support plate and a second end of the locking stopper faces the lock body, respectively.

3. The safety locking mechanism for a lockset according to claim 1, wherein an inner surface of the specially-shaped hole comprises a helical surface fitted with the helical inclined surface, and when the helical inclined surface passes through the specially-shaped hole, the helical surface is driven by the helical inclined surface to rotate radially.

4. The safety locking mechanism for a lockset according to claim 3, wherein after when the cover plate is removed, the locking push rod is elevated by the compression force of the locking compression spring, the locking push rod axially moves upward, and the helical inclined surface drives the locking stopper to rotate through the specially-shaped hole radially.

5. The safety locking mechanism for a lockset according to claim 2, wherein when the locking push rod presses against the cover plate, the locking stopper is located outside a moving passage of the locking shaft of the lockset.

6. The safety locking mechanism for a lockset according to claim 2, wherein when the cover plate is removed from the support plate, the locking stopper rotates to an intersection with a moving passage of the locking shaft of the lockset.

7. The safety locking mechanism for a lockset according to claim 2, wherein the direction-limiting shaft is fixed at one end of the locking push rod, and the other end of the locking push rod passes through the specially-shaped hole of the locking stopper and the support plate in order, and presses against the cover plate.

8. The safety locking mechanism for a lockset according to claim 7, wherein the locking shaft is used to control locking and rotation of the lock tongue of the lockset.

9. The safety locking mechanism for a lockset according to claim 1, wherein the cross-sectional shape of the direction-limiting shaft comprises a polygon.

10. The safety locking mechanism for a lockset according to claim 1, wherein the direction-limiting shaft comprises a circular shaft, the circular shaft defines an axial key groove, the direction-limiting groove comprises a matching limiting key on an inner wall of the direction-limiting groove, the limiting key fits in the axial key groove and is slidable in the key groove in an axial direction to ensure that the locking push rod moves only in the axial direction.

11. The safety locking mechanism for a lockset according to claim 2, wherein the cross-sectional shape of the direction-limiting shaft is a polygon.

12. The safety locking mechanism for a lockset according to claim 3, wherein the cross-sectional shape of the direction-limiting shaft is a polygon.

13. The safety locking mechanism for a lockset according to claim 4, wherein the cross-sectional shape of the direction-limiting shaft is a polygon.

14. The safety locking mechanism for a lockset according to claim 2, wherein the direction-limiting shaft comprises a circular shaft, the circular shaft defines an axial key groove, the direction-limiting groove comprises a matching limiting key on an inner wall of the direction-limiting groove, the limiting key fits in the axial key groove and is slidable in the key groove in an axial direction to ensure that the locking push rod moves only in the axial direction.

15. The safety locking mechanism for a lockset according to claim 3, wherein the direction-limiting shaft comprises a circular shaft, the circular shaft defines an axial key groove, the direction-limiting groove comprises a matching limiting key on an inner wall of the direction-limiting groove, the limiting key fits in the axial key groove and is slidable in the key groove in an axial direction to ensure that the locking push rod moves only in the axial direction.

16. The safety locking mechanism for a lockset according to claim 4, wherein the direction-limiting shaft comprises a circular shaft, the circular shaft defines an axial key groove, the direction-limiting groove comprises a matching limiting key on an inner wall of the direction-limiting groove, the limiting key fits in the axial key groove and is slidable in the key groove in an axial direction to ensure that the locking push rod moves only in the axial direction.

17. The safety locking mechanism for a lockset according to claim 5, wherein the direction-limiting shaft comprises a circular shaft, the circular shaft defines an axial key groove, the direction-limiting groove comprises a matching limiting key on an inner wall of the direction-limiting groove, the limiting key fits in the axial key groove and is slidable in the key groove in an axial direction to ensure that the locking push rod moves only in the axial direction.

18. The safety locking mechanism for a lockset according to claim 6, wherein the direction-limiting shaft comprises a circular shaft, the circular shaft defines an axial key groove, the direction-limiting groove comprises a matching limiting key on an inner wall of the direction-limiting groove, the limiting key fits in the axial key groove and is slidable in the key groove in an axial direction to ensure that the locking push rod moves only in the axial direction.

19. The safety locking mechanism for a lockset according to claim 7, wherein the direction-limiting shaft comprises a circular shaft, the circular shaft defines an axial key groove, the direction-limiting groove comprises a matching limiting key on an inner wall of the direction-limiting groove, the limiting key fits in the axial key groove and is slidable in the key groove in an axial direction to ensure that the locking push rod moves only in the axial direction.

20. The safety locking mechanism for a lockset according to claim 8, wherein the direction-limiting shaft comprises a circular shaft, the circular shaft defines an axial key groove, the direction-limiting groove comprises a matching limiting key on an inner wall of the direction-limiting groove, the limiting key fits in the axial key groove and is slidable in the key groove in an axial direction to ensure that the locking push rod moves only in the axial direction.

* * * * *